US007240856B2

(12) United States Patent
Abe

(10) Patent No.: US 7,240,856 B2
(45) Date of Patent: Jul. 10, 2007

(54) FUEL INJECTION CONTROL DEVICE

(75) Inventor: Hidefumi Abe, Sendai (JP)

(73) Assignee: Keihin Corporation, Tokyo (JP)

( * ) Notice: Subject to any disclaimer, the term of this patent is extended or adjusted under 35 U.S.C. 154(b) by 31 days.

(21) Appl. No.: 10/969,246

(22) Filed: Oct. 21, 2004

(65) Prior Publication Data

US 2005/0145714 A1 Jul. 7, 2005

(30) Foreign Application Priority Data

Oct. 24, 2003 (JP) ..... P 2003-364900

(51) Int. Cl.
*B05B 1/08* (2006.01)

(52) U.S. Cl. ..... 239/102.2; 239/88; 239/91; 239/533.2; 239/585.1; 123/446; 123/498; 123/499

(58) Field of Classification Search ..... 239/102.1, 239/102.2, 88, 89, 91, 533.2, 585.1, 585.4, 239/585.5; 123/498, 499
See application file for complete search history.

(56) References Cited

U.S. PATENT DOCUMENTS

| | | | | |
|---|---|---|---|---|
| 2,495,740 | A * | 1/1950 | Labin et al. | 333/148 |
| 2,846,666 | A * | 8/1958 | Epstein et al. | 365/157 |
| 3,320,596 | A * | 5/1967 | Smith, Jr. et al. | 365/157 |
| 4,653,448 | A * | 3/1987 | Ohmori et al. | 123/446 |
| 5,865,373 | A * | 2/1999 | Buckley et al. | 239/90 |
| 5,979,803 | A * | 11/1999 | Peters et al. | 239/533.4 |
| 6,279,842 | B1 * | 8/2001 | Spain | 239/585.1 |
| 6,298,829 | B1 * | 10/2001 | Welch et al. | 123/467 |
| 6,557,776 | B2 * | 5/2003 | Carroll et al. | 239/5 |
| 6,651,630 | B2 * | 11/2003 | Hiraku et al. | 123/506 |
| 6,789,777 | B2 * | 9/2004 | Weber | 251/129.06 |

FOREIGN PATENT DOCUMENTS

| | | |
|---|---|---|
| JP | H08-200180 | 8/1996 |
| JP | H08-232791 | 9/1996 |
| JP | 09-310655 | 12/1997 |
| JP | H11-294298 | 10/1999 |
| JP | H11-351093 | 12/1999 |
| JP | 2000-274329 | 10/2000 |
| JP | 2001-152939 | 6/2001 |
| JP | 2001-336443 | 12/2001 |
| JP | 2002-021680 | 1/2002 |

* cited by examiner

*Primary Examiner*—Kevin Shaver
*Assistant Examiner*—Trevor McGraw
(74) *Attorney, Agent, or Firm*—Squire, Sanders & Dempsey L.L.P.

(57) ABSTRACT

This fuel injection control device includes: a fuel injection valve; a piezoelectric element or a solenoid which drives the fuel injection valve; a fuel pump which pressurizes fuel and supplies it to the fuel injection valve; a magnetostrictive element which drives the fuel pump; and a magnetostrictive element driving coil which drives the magnetostrictive element; and the magnetostrictive element driving coil also serves as a voltage elevation coil for a drive circuit which drives the piezoelectric element or the solenoid.

10 Claims, 8 Drawing Sheets

FUEL INJECTION CONTROL DEVICE

BACKGROUND OF THE INVENTION

1. Field of the Invention

The present invention relates to a fuel injection control device.

Priority is claimed on Japanese Patent Application No. 2003-364900, filed Oct. 24, 2003, the content of which is incorporated herein by reference.

2. Description of Related Art

A fuel injection control device has been known which controls the injection of fuel electrically order to enhance the efficiency of combustion. In a fuel injection valve of such a fuel injection control device, the opening and closing of the valve is performed by driving a movable iron core portion with the magnetic force which is generated by a solenoid (for example, refer to Japanese Patent Application, First Publication No. 2000-274329).

Furthermore, since it is necessary to control the fuel injection control amount minutely in order to enhance the efficiency of combustion, sometimes a piezoelectric element such as a piezo element or a magnetostrictive element or the like is utilized for opening and closing the fuel injection valve (for example, refer to Japanese Patent Application, First Publication No. H09-310655).

In recent years, in order to enhance the efficiency of combustion, so called direct injection type engines have come into use, in which the fuel is directly injected into the engine. With this type of engine, since the structure is such that the fuel which is compressed at a high pressure is sent to a fuel injection device which is provided at the cylinder head portion and is directly injected into the cylinders, accordingly a high pressure fuel pump, a high pressure fuel pipe, a fuel injection valve whose responsiveness is good, and a voltage elevation circuit which drives them all, are essential elements in the structure.

However, with a fuel injection valve of the former solenoid type, or with one of the latter type which utilizes a piezoelectric element or a magnetostrictive element or the like, there is the problem that the system as a whole becomes costly, since it is necessary to provide, as separate items, not only the voltage elevation circuit, but also a high pressure pump and a high pressure fuel pipe and the like.

Thus, the present invention proposes a fuel injection control device with which a reduction in cost can be anticipated, since the high pressure fuel pipe is made unnecessary by integrating together the fuel injection valve, whose responsiveness is good, and the high pressure fuel pump.

SUMMARY OF THE INVENTION

The present invention proposes a fuel injection control device which includes: a fuel injection valve; a piezoelectric element or a solenoid which drives the fuel injection valve; a fuel pump which pressurizes fuel and supplies it to the fuel injection valve; a magnetostrictive element which drives the fuel pump; and a magnetostrictive element driving coil which drives the magnetostrictive element; and wherein the magnetostrictive element driving coil also serves as a voltage elevation coil for a drive circuit which drives the piezoelectric element or the solenoid.

According to the fuel injection control device of the present invention, since the magnetostrictive element driving coil also serves as the voltage elevation coil for the drive circuit which drives the piezoelectric element or the solenoid, accordingly it is possible to implement fuel injection of good responsiveness, and also it becomes possible to anticipate a reduction in cost by decreasing the number of components. Therefore, it is possible to build the entire system of the fuel injection control device at a low cost.

With the fuel injection control device of the present invention, it is preferable that the fuel injection valve and the fuel pump to be integrated together.

In addition to the above described beneficial results, since it becomes possible to shorten the distance from the fuel pump to the fuel injection valve, thus shortening the dispatching distance for the pressurized fuel, and it becomes possible to utilize low cost low pressure components for the structural elements such as the high pressure pump and the high pressure fuel pipe and so on for dispatching the fuel from the fuel tank, accordingly it is possible to anticipate a reduction in cost by decreasing the unit cost of the structural components which up until now were high cost items.

With the fuel injection control device of the present invention, it is preferable that the drive circuit which drives the magnetostrictive element and the drive circuit which drives the piezoelectric element or the solenoid to be provided within a driver unit; and for the driver unit to be integrated with the fuel injection valve and the fuel pump.

Since, it becomes possible to eliminate the external wiring for connecting the magnetostrictive element to the driver unit, and also the external wiring for connecting the piezoelectric element or the solenoid to the driver unit, so that it becomes possible to take effective advantage of the empty space around the magnetostrictive element, accordingly it is possible to implement a yet further reduction in the space which is used by the system of the fuel injection control device as a whole.

With the fuel injection control device of the present invention, it is preferable that the drive circuit which drives the magnetostrictive element and the drive circuit which drives the piezoelectric element or the solenoid to be provided within a driver unit; and for the driver unit, the fuel pump, and the fuel injection valve to be provided adjacent to one another.

Since, the various distances between the fuel pump, the fuel injection valve, and the driver unit become shorter, and it becomes possible to shorten the wiring and the high pressure fuel pipe which are connected between these various mechanisms, accordingly it is possible to anticipate a further reduction in the cost.

With the fuel injection control device of the present invention, it is preferable that a high pressure flow conduit which supplies fuel from the fuel pump to the fuel injection valve is provided in the vicinity of an opening and closing valve of the fuel injection valve.

Since, it becomes possible to suppress pressure loss of the fuel which is supplied from the fuel pump to the fuel injection valve to the maximum possible extent, accordingly it is possible to perform injection while still maintaining the pressure of the fuel which is supplied into the combustion chamber of the internal combustion engine at a high pressure which corresponds to the internal pressure in the cylinder.

DETAILED DESCRIPTION OF THE INVENTION

The first embodiment of the present invention will now be explained with reference to the drawings.

Figure 1:
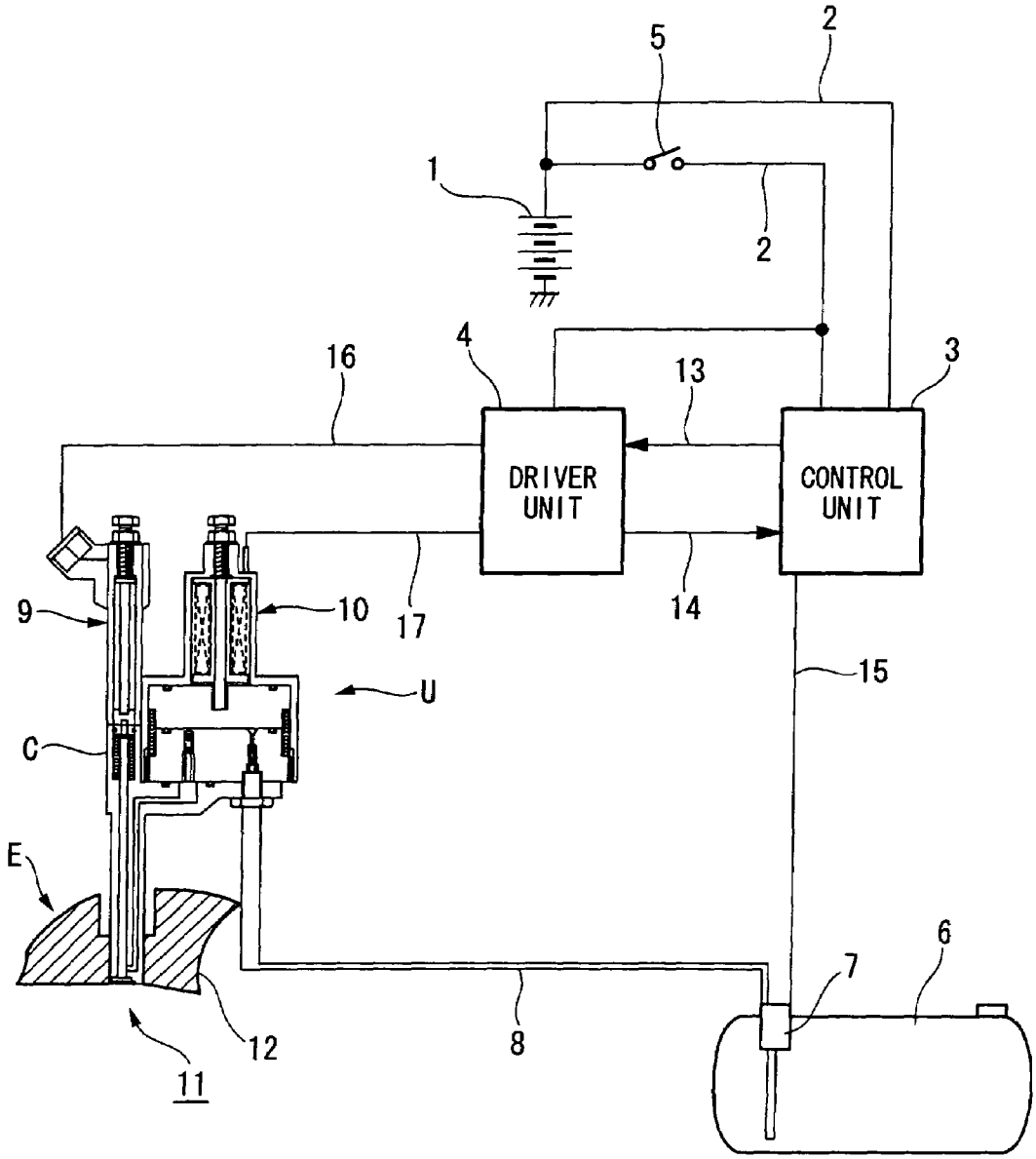
FIG. 1 is a structural system figure for the first embodiment of the present invention.

FIG. 1 shows the system structure of the present invention. The reference numeral 1 denotes a 12V battery, and a control unit 3 and a driver unit (a driver unit) 4 are connected to this battery (BATT) 1 via power supply lines 2 and 2. One of the power supply lines 2 has an ignition switch (IG) 5. One of the power supply lines 2 is branched off at the downstream side of the ignition switch 5, and is connected to the driver unit 4.

The reference numeral 6 denotes a fuel tank, and a low pressure pump 7 of the fuel tank 6 is connected to a fuel injection unit U via a low pressure fuel pipe 8. This fuel injection unit U is one which includes, unitarily within a casing C, an injector 9 (a fuel injection valve) of a piezo element (piezoelectric element) type, and a high pressure fuel pump 10 (a fuel pump) of a magnetostrictive element type. The fuel injection unit U is fixed in the cylinder head 12 of an engine E, an opening and closing valve (a valve main body 35 which will be described hereinafter) of the injector 9 is disposed within a combustion chamber 11 of the engine E.

The control unit 3 and the driver unit 4 are connected by a signal line 13 which transmits an injection signal from the control unit 3 to the driver unit 4, and a signal line 14 which transmits a fail safe signal from the driver unit 4 to the control unit 3.

The low pressure pump 7 of the fuel tank 6 and the control unit 3 are connected by a signal line 5 which transmits and receives a low pressure fuel pump drive signal.

The fuel injection unit U and the driver unit 4 are connected together by a high voltage signal line 16 which transmits and receives a drive signal, and a signal line 17 which transmits and receives a magnetostrictive drive signal. In concrete terms, the high voltage signal line 16 is connected to the side of the injector 9, while the signal line 17 is connected to the side of the high pressure fuel pump 10.

Next, the fuel injection unit U, which uses a piezo element which is a piezoelectric element, will be explained based upon FIG. 2.

Figure 2:
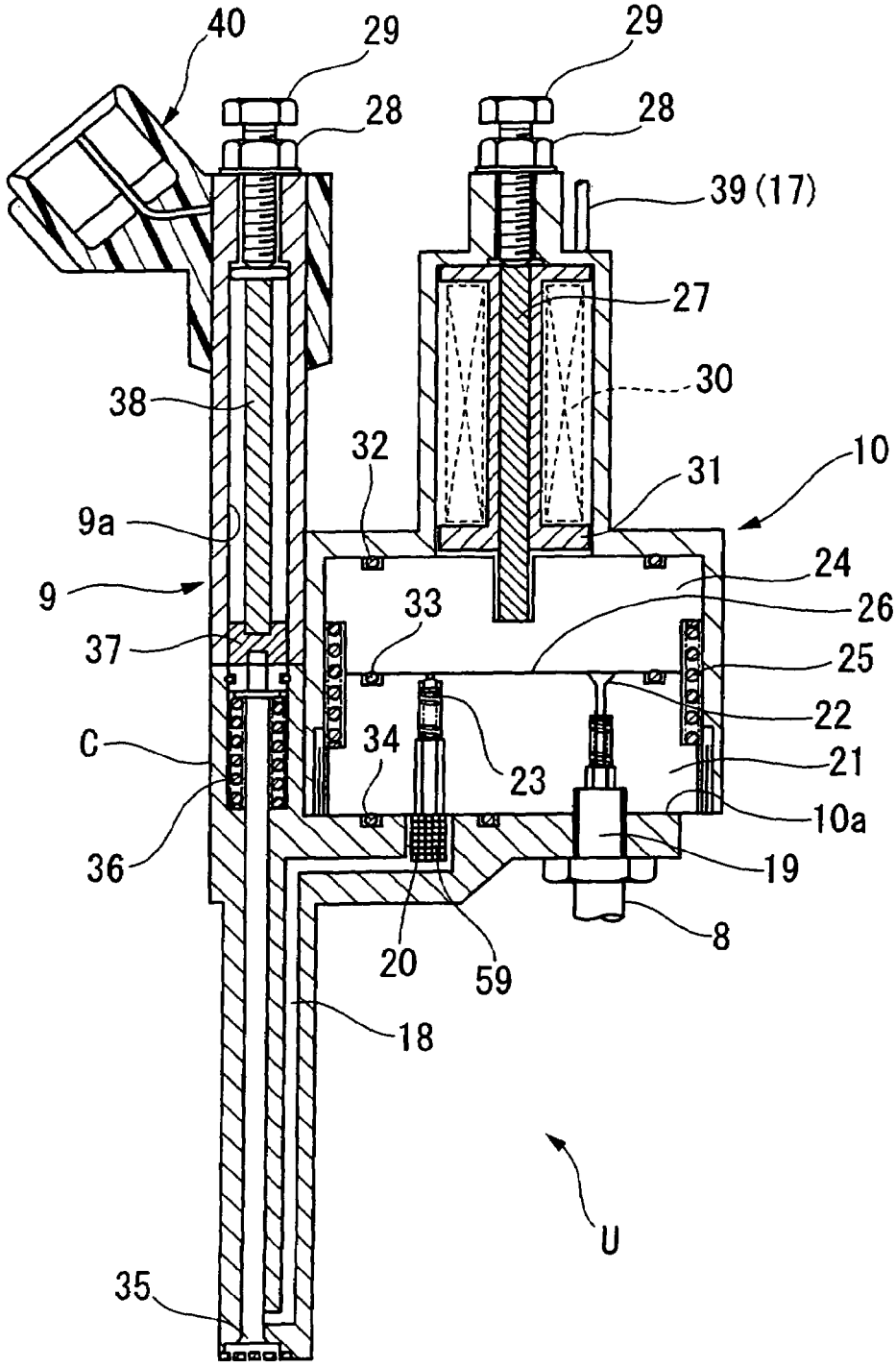
FIG. 2 is a sectional view of a fuel injection unit in the first embodiment of the present invention.

As shown in FIG. 2, a housing portion 9*a* of the injector 9 and a housing portion 10*a* of the high pressure fuel pump 10 are formed within the casing of the fuel injection unit U. These housing portions 10*a* and 9*a* are connected by a high pressure fuel passage 18. A connection port 19 for the low pressure fuel pipe 8 is provided to this housing portion 10*a* of the high pressure fuel pump 10, and an outlet side port 20 of the high pressure fuel passage 18 in which a filter 59 is provided together with the connection port 19. At the lower half portion of the housing portion 10*a* of the high pressure fuel pump, a valve block 21 is disposed in a position which corresponds to the connection port 19 of the low pressure fuel pipe 8 and the outlet side port 20 of the high pressure fuel passage 18. In this valve block 21, an aspiration valve 22 is provided in a position which corresponds to the connection port 19 of the low pressure fuel pipe 8, and a pressurizing valve 23 is provided in a position which corresponds to the outlet side port 20 of the high pressure fuel passage 18.

When the housing portion 10*a* of the high pressure fuel pump 10 goes to a negative pressure condition, the aspiration valve 22 opens and feeds fuel in from the side of the low pressure fuel pipe 8 into a pump pressurizing chamber 26 which will be described hereinafter. One the other hand, in the pressurizing valve 23, when a pressure above a predetermined level within the pump pressurizing chamber 26 is applied, the valve main body 35 (the opening and closing valve) opens, and fuel at high pressure is supplied to the side of the injector 9 via the high pressure fuel passage 18.

In the upper half portion of the housing portion 10*a* of the high pressure fuel pump 10, there is provided a piston 24 which is tightly fitted into the valve block 21. This piston 24 is biased by a piston return spring 25 between itself and the valve block 21 in a direction so as to be normally separated therefrom, and, although the volume of the pump pressurizing chamber 26 is extremely small, in this position, fuel is charged thereinto. It should be understood that, for the convenience of illustration, hatching upon the valve block 21 and the piston 24 is omitted.

A pole shaped magnetostrictive element 27 is disposed at the central portion of the piston 24. The upper end portion of the magnetostrictive element 27 is pressed against the piston 24 by a position adjustment bolt 29 provided with a nut 28, for adjusting the set force. A coil 30 (a magnetostrictive element driving coil) is provided around the outside of this magnetostrictive element 27, and this coil 30 is set in a bobbin 31 and mounted over the magnetostrictive element 27. Furthermore, this coil 30 is connected to the driver unit 4 via a harness 39 which leads out from the coil in order to conduct electricity thereto. It should be understood that, between the upper wall of the casing C and the piston 24, there is disposed an O-ring 32 so as to surround the magnetostrictive element 27. Furthermore, between the valve block 21 and the piston 24, there is provided an O ring 33 which surrounds the aspiration valve 22 and the pressurizing valve 23, and also an O-ring 34 is provided between the lower wall of the housing portion 10*a* and the valve block 21, surrounding the pressurizing valve 23.

On the other hand, the valve main body 35 is provided inside the housing portion 9*a* of the injector 9, at the position where the discharge end of the high pressure fuel passage 18 opens. This valve main body 35 is provided via a plunger return spring 36 so as to be freely slidable, and is pressed by a piezo element 38 via a piston 37 at the upper end of the valve main body 35.

A coupler 40 made by resin molding is provided at the upper side wall of the housing portion 9*a* so as to project therefrom. This coupler 40 is connected to the piezo element 38, and the voltage signal line 16 (refer to FIG. 1) is connected thereto. The piezo element is connected to the driver unit 4 via this voltage signal line 16.

It should be understood that, in the same way as the magnetostrictive element 27, the piezo element 38 is pressed by a bolt 29 which is provided with a nut 38 so that its position can be adjusted by adjusting the set amount of force. The end of the casing C at which the valve main body 35 is disposed is formed to extend downwards, and this end tip portion is arranged so as to stick into the combustion chamber 11.

Figure 3:
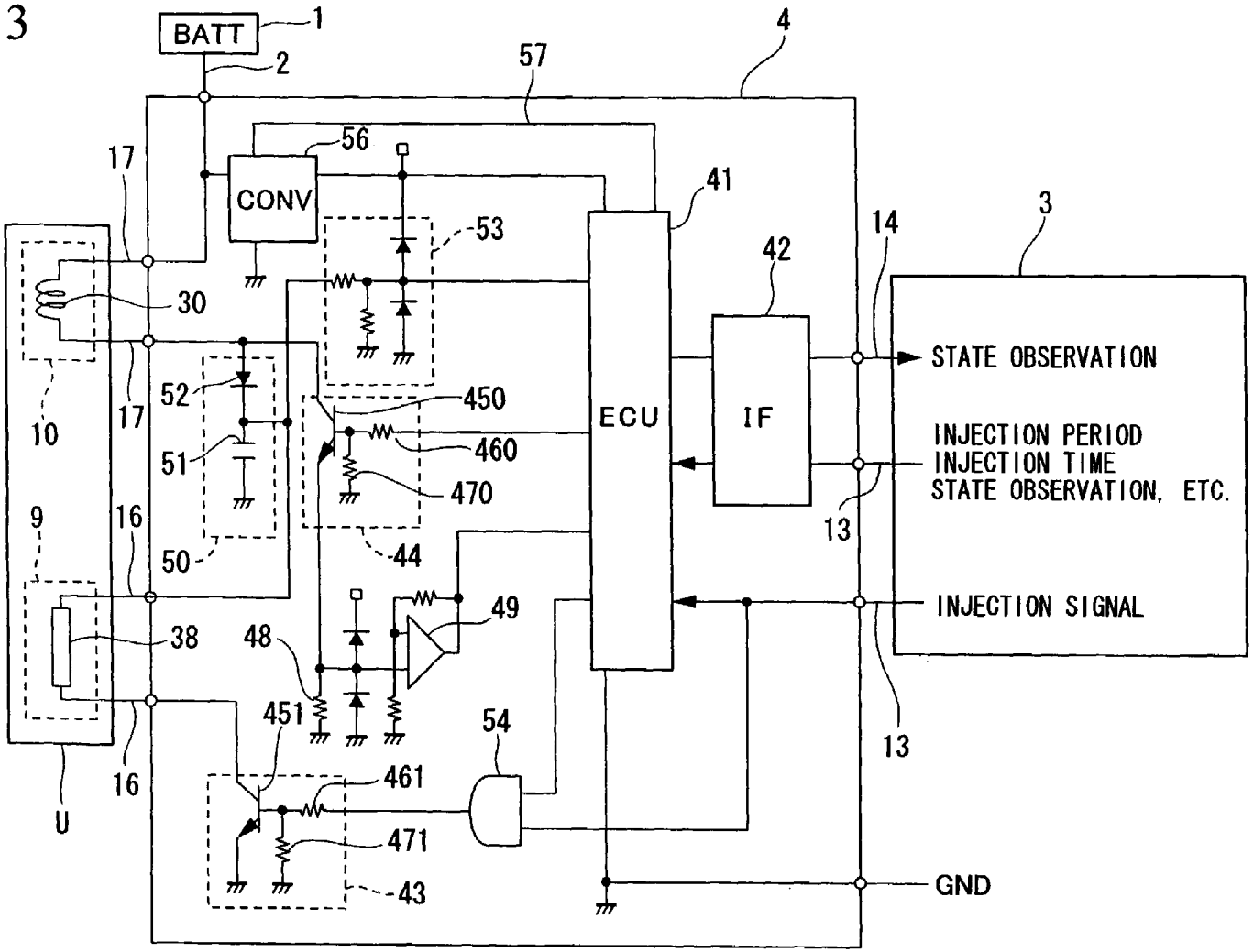
FIG. 3 is an internal structural circuit diagram of a driver unit of the first embodiment of the present invention.

Next, the structure of the driver unit 4 will be explained based upon FIG. 3. As shown in FIG. 3, the driver unit 4 includes a control computer (ECU) 41 which performs this control. This control computer 41 is connected via a communication interface circuit (IF) 42, or directly, to the control unit 3. In concrete terms, the control computer 41 outputs a state observation signal to the control unit 3 via the communication interface circuit 42, and the control unit 3 outputs an injection period signal, an injection time signal, and the state observation signal and the like to the control computer 41 via the communication interface circuit 42.

Furthermore, the control unit 3 outputs an injection signal directly to the control computer 41.

A coil drive circuit 44 is connected to the control computer 41 in order to drive the magnetostrictive element 27. This coil drive circuit 44 is a device for driving the coil 30, and it includes a transistor 450 and resistors 460 and 470. The collector of the transistor 450 is connected to the earth side of the coil 30 for magnetostriction, and the emitter of the transistor 450 is connected to earth via the resistor 48. Furthermore, the base of the transistor 450 is connected to the control computer 41 via the resistor 460, and is employed for inputting the magnetostrictive element drive signal for the pump from the control computer 41.

It should be understood that the resistor 470, which acts as a protective resistor, is connected between the base of the transistor 450 and earth.

The resistor 48, limits the electrical current which flows in the coil 30, and also is utilized as a so called shunt resistor which converts the magnitude of this electrical current into a voltage signal (a coil electrical current monitoring signal). An end of the resistor 48, which is connected to the coil drive circuit 44, is connected to the control computer 41 via an amplifier 49. This amplifier 49 is amplifies the voltage signal and outputting it to the control computer 41.

A voltage elevation circuit 50 (a drive circuit) is connected to the collector of the transistor 450 of the coil drive circuit 44, so as to be in parallel with this coil drive circuit 44. This voltage elevation circuit 50 consists of a high voltage condenser 51 and a diode 52.

An end of the high voltage condenser 51 is connected to a monitor circuit 53 for monitoring the voltage which has been elevated and the piezo element 38 via the high voltage signal line 16. This monitor circuit 53 is connected to the control computer 41. The monitor circuit 53 divides the high voltage which has been generated in the voltage elevation circuit 50, and outputs it as a voltage elevation voltage monitor signal of low voltage to the control computer 41.

An adder 54 which is provided with two input terminals and one output terminal is connected to the control computer 41. One of these input terminals is for inputting a fail gate signal from the control computer, while the other is for inputting the injection signal which has been branched off. Furthermore, the output terminal is connected to a piezo drive circuit 43. Just like the coil drive circuit 44, this piezo drive circuit 43 consists of a transistor 451 and resistors 461 and 471, and the drive signal from the adder 54 is inputted thereinto. The collector of the transistor 451 is connected to the piezo element 38, while its emitter is connected to earth. Furthermore, the base is connected to the output terminal of the adder 54 via the resistor 461.

The fail gate signal is for immediately stopping fuel injection by being inputted to the adder 54 when it is determined that it is necessary to stop the injection of fuel based upon the signals which are inputted to the control computer 41. Accordingly, normally, the piezo drive circuit 43 is controlled by the adder 54 by utilizing only the injection signal which is inputted from the control unit 3.

It should be understood that, just as with the coil drive circuit 44, the resistor 471 for protection is connected between the base and the earth of the transistor 451 of the piezo drive circuit 43.

A power circuit (CONV) 56 is connected to the control computer 41. This power circuit 56 is connected by being branched off from between the battery 1, which is the external voltage supply, and the coil for magnetostriction 30. Furthermore, between the control computer 41 and the power circuit 56, apart from the above described, there is also connected a signal line 57 which inputs and outputs a reset signal and a state observation signal.

It should be understood that an earth (GND), which serves as a reference potential, is connected to the control computer 41.

Figure 4:
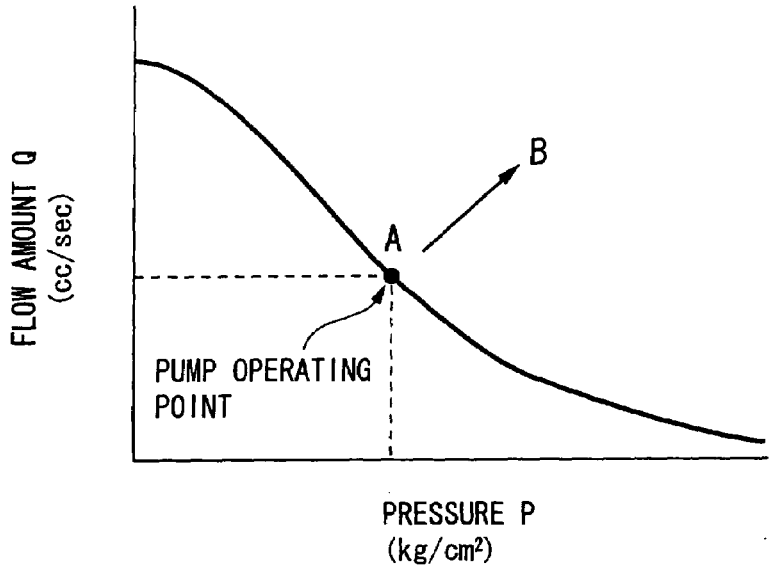
FIG. 4 is a graph showing a relationship between fluid amount and pressure, in the first embodiment of the present invention.

Next, the characteristics of the high pressure fuel pump 10 will be explained based upon FIG. 4. FIG. 4 shows the fluid amount Q along the vertical axis and the pressure P along the horizontal axis, and shows by the solid line the characteristic of the high pressure fuel pump when the drive frequency, the duty ratio, and the coil peak electrical current which drives the pump are kept fixed. The broken line in the figure is for showing the operating point of the pump in this embodiment.

In order to pull out the operating point A of this pump in the direction of B, the magnetic field in the coil 30 may be made strong with the drive frequency of the pump and the electrical current passing through the coil (N•I). In other words, since the fluid amount Q rises when the drive frequency of the pump is raised, and that the pressure P and the fluid amount Q both rise at the same time when the electrical current which flows in the coil becomes greater, accordingly the fluid amount Q at the pump operating point which is demanded from the engine characteristic, and the drive frequency, the duty ratio, and the electrical current which flows in the coil which have been obtained by the balance from the voltage elevation characteristic of a voltage elevation circuit 50 to be described hereinafter are obtained. Thus, by calculation processing by the driver unit 4, it becomes possible to drive the magnetostrictive element 27 and the piezo element 38.

Next, the characteristics of the voltage elevation circuit 50 which drives the piezo element 38 will be explained based upon FIG. 5.

Figure 5:
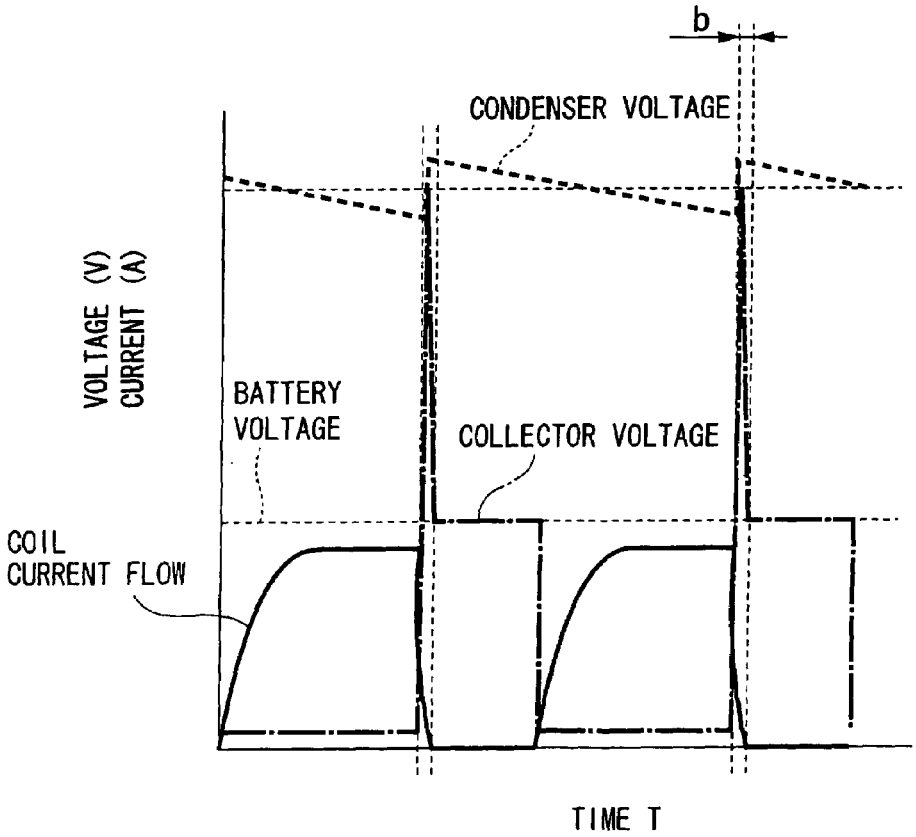
FIG. 5 is a waveform graph for a voltage elevation circuit in the first embodiment of the present invention.

FIG. 5 is a figure showing the voltage and the electrical current along the vertical axis and time T along the horizontal axis, and, just like FIG. 4, shows the voltage and the electrical current at various points when the drive frequency, the duty ratio, and the coil peak electrical current are fixed.

During the driving of the high pressure fuel pump, when the coil drive circuit 44 is turned ON and OFF, the coil electrical current which flows in the coil 30 (shown in the figure by the solid line) is turned ON and OFF. When the coil electrical current in this coil 30 is turned OFF, a voltage elevation energy b ($L \cdot I2$) is generated as the collector voltage (shown by the single dotted broken line in the figure) between the collector of the transistor 450 of the coil drive circuit 44 and earth. Since this voltage elevation energy b is usually regarded as an energy loss, this voltage elevation energy b is charged into the condenser 51 of the voltage elevation circuit 50, and is taken advantage of as energy ($C \cdot V2$, shown by the thick broken line condenser voltage in the figure) for driving the piezo element 38.

It should be understood that the L denotes the inductance of the coil 30, I denotes the electrical current which flows in the coil 30, C denotes the capacitance of the condenser 51, and V denotes the voltage elevation voltage which is generated in the condenser 51.

Next, the case in which the above described fuel injection unit U is applied to, for example, a four cylinder in line engine E will be explained based upon FIG. 6.

Figure 6:
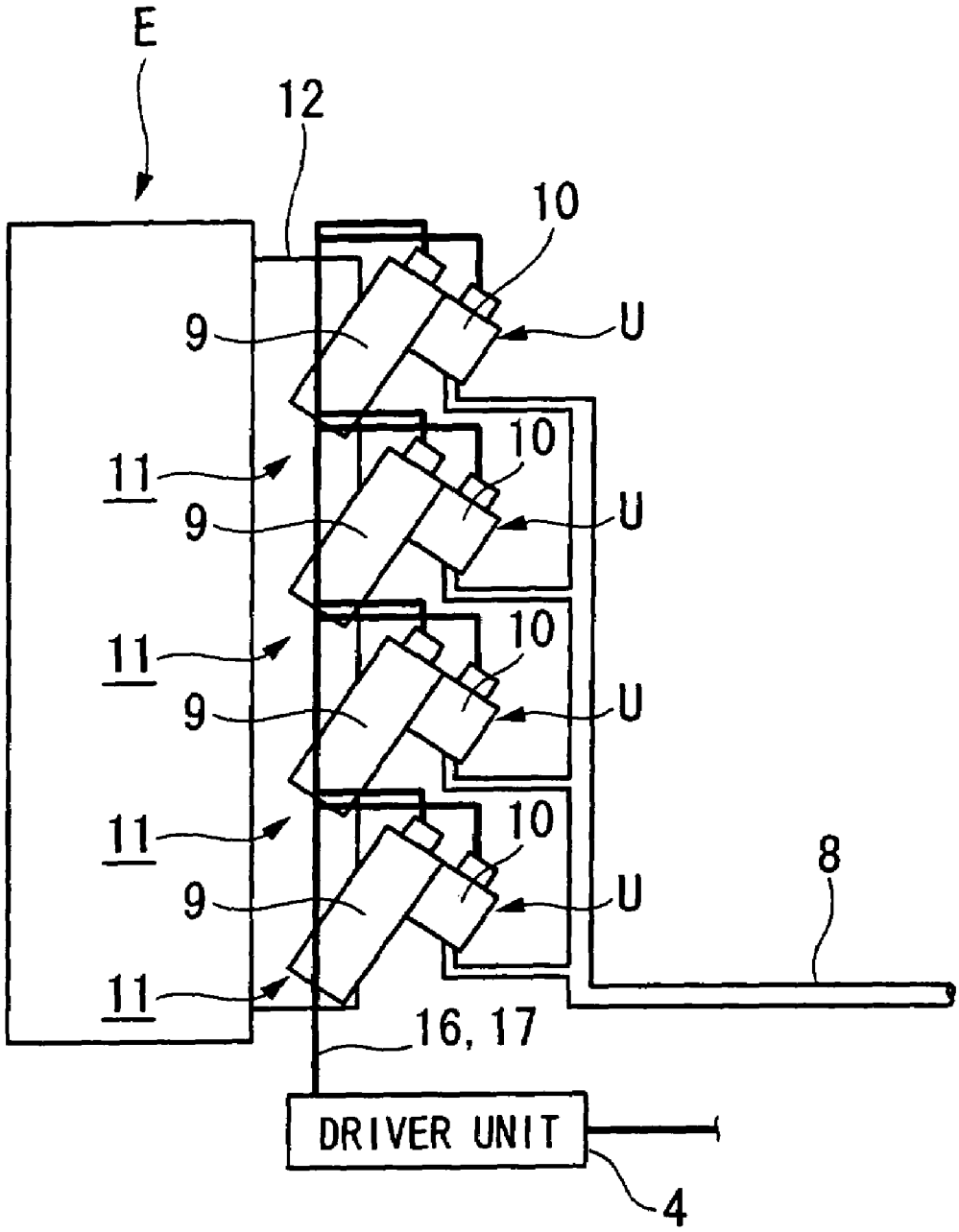
FIG. 6 is a structural view of the first embodiment of the present invention.

As shown in FIG. 6, these fuel injection units U are provided to each cylinder of the cylinder head 12, and the injectors 9 of these fuel injection units U and the high pressure fuel pump 10 are connected to the driver unit 4 via signal lines.

The low pressure fuel pipe 8 is connected by being branched off to the high pressure fuel pump 10 of each of the fuel injection units U. As previously described, the projected portions of the injectors 9 which are adjacent to these high pressure fuel pumps 10 are disposed so as to be stuck into the various combustion chambers 11.

It should be understood that, for the convenience of illustration, the drive unit 4 of FIG. 6 is shown as a unit which holds, within a single case, four circuit portions which are driver units 4 corresponding to the various fuel injection units U.

Next, the operation will be explained. When an injection signal is sent from the control unit 3 to the driver unit 4 for fuel injection, a pump magnetostrictive element drive signal is inputted from the control computer 41 to the base of the transistor 450 (the coil drive circuit 44), and electrical current flows from the battery 1 to the coil 30 in correspondence to this pump magnetostrictive element drive signal. At this time, the magnetostrictive element 27 is displaced by the magnetic field which is generated in the coil 30.

In the high pressure pump of the fuel injection unit U, since, the piston 24 is pressed from above by the magnetostrictive element 27, accordingly the fuel which has been sucked into the pump pressurizing chamber 27 is compressed. When a pressure greater than a predetermined level is applied to the pump pressurizing chamber 26, the valve of the pressurizing valve 23 opens, and fuel at high pressure is pushed out into the high pressure fuel passage 18. This fuel at high pressure is pressed out via the high pressure fuel passage 18 to the vicinity of the valve main body 35 of the injector 9.

In the voltage elevation circuit 50, the condenser 51 is charged by the voltage elevation voltage (the collector voltage of FIG. 5) which has been generated in the coil 30 at the same time as the magnetostrictive element 27 is displaced. When the injection signal is inputted from the control unit 3 to the base of the transistor 451 (the piezo drive circuit 43), the voltage which has been charged into the condenser 51 (the condenser voltage of FIG. 5) is applied to the piezo element 38 of the injector 9, and this piezo element 38 is displaced.

In the injector 9 of the fuel injection unit U, due to the displacement of the piezo element 38, the piston 37 is pressed from above by the piezo element 38. The valve main body 35 opens along with the piston 37, and the fuel which has been supplied at pressure from the high pressure fuel pump 10 is supplied into the combustion chamber 11 of the engine E.

Therefore, according to the above described first embodiment, since the coil 30 of the magnetostrictive element 27 also serves as the coil of the voltage elevation circuit 50 which drives the piezo element 38, as a result, along with it being possible to implement fuel injection of good responsiveness, it is also possible to anticipate a reduction in the cost, due to reduction of the number of components.

Furthermore, since the injector 9 and the high pressure fuel pump are housed within the same casing C, it becomes possible to perform supply of the fuel which has been dispatched from the high pressure fuel pump 10 to the valve main body 35 while suppressing pressure loss thereof to the maximum extent possible.

Moreover, it is possible to anticipate a reduction in the cost, since the fuel pipe from the fuel tank 6 (the low pressure fuel pipe 8) may be a low pressure one, and accordingly it is possible to eliminate the high pressure fuel pipe which was constituted by the high pressure fuel passage 18.

Thus, since it becomes possible to perform the fuel injection while maintaining the pressure of the fuel which is supplied to within the combustion chamber 11 of the engine E at a high pressure which corresponds to the pressure within the combustion chamber 11 of the engine E, accordingly the present invention is suitable for application to a direct injection type engine which is advantageous from the point of view of responsiveness.

Next, a fuel injection unit U which utilizes a solenoid type injector, which is a second embodiment of the present invention, will be explained based upon FIG. 7.

Figure 7:
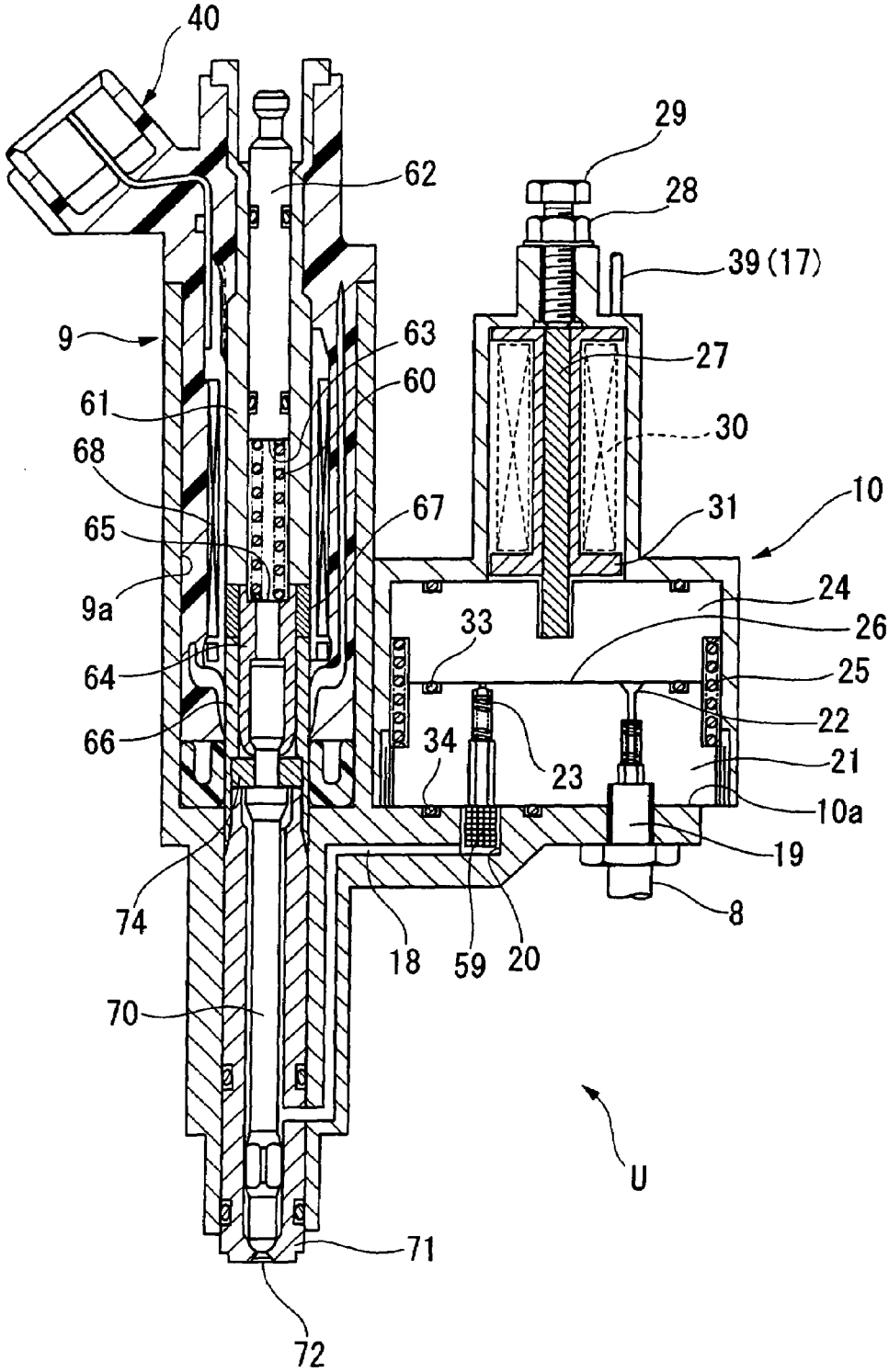
FIG. 7 is a sectional view corresponding to FIG. 2, of the second embodiment of the present invention.

It should be understood that since, apart from the solenoid type injector, the other structures and operation are the same as for the previously described first embodiment, in FIG. 7 the same reference symbols are affixed to the same parts, and explanation thereof will be curtailed.

As shown in FIG. 7, in the housing portion 9*a* of the injector 9, at the location where the discharge end of the high pressure fuel passage 18 opens, there is provided a needle 70 (an opening and closing valve). This needle 70 is provided so as to be freely slidable via a spring 60. The upper portion of the spring 60 is fitted into a concave portion 63 which is formed by a circular cylinder shaped fixed core 61 and a inner collar 62 which is pressed from upward into its interior. This inner collar 62 is arranged to press against the upper surface of the spring 60, just like the nut 28 which adjusted the set amount of force.

The lower portion of the spring 60 is fitted into a concave portion 65 which is formed in the upper portion of a movable core 64. This movable core 64 is made as a unit with the upper portion of the needle 70, and a valve body 66 which is made from metal and which is formed in a circular cylindrical shape is provided around its periphery.

Accordingly, the pressure of the spring 60 upon the concave portion 65 acts as a force which biases the needle 70 in the downwards direction.

It should be understood that the valve body 66, a pipe 67 made from a non magnetic substance which is provided at its upper portion, and the fixed core 61 are made into a single unit by being welded together.

Into the lower end of the valve body 66 there is fitted the upper end of a valve seat 71, in which an ejection aperture 72 is formed at its lower end in a circular cylindrical shape. This valve seat 71 is pressed into the housing portion 9*a*.

The ejection aperture 72 is made to correspond to the shape of the lower end portion of the needle 70.

A coil 68 (a solenoid) is wound upon the outer periphery of the lower half portion of the fixed core 61, over the pipe 67 which is made from non magnetic material and the movable core 64. This coil 68 is connected to the driver unit 4 via a coupler 40 which is provided upon the upper side wall of the injector 9.

In concrete terms, the high voltage from the driver unit 4 is supplied to the coil 68, and the movable core 64 slides in the upward direction along the valve body 66 due to the magnetic force which is generated by the coil 68, so that the ejection aperture 72 is opened up. The fuel which is dispatched under pressure from the high pressure fuel pump 10 is supplied into the combustion chamber 11 from the ejection aperture 72 which is thus opened up.

Thus, according to the above described second embodiment, just like the first embodiment, the coil 30 of the magnetostrictive element 27 also serves as a coil for the voltage elevation circuit 50 which drives the solenoid, as a result, along with it being possible to implement injection of fuel with good responsiveness, it is also possible to anticipate a reduction in the cost, due to the fact that the number of components is reduced.

Furthermore, since the injector 9 and the high pressure fuel pump are housed within the same casing C, it becomes possible to supply the fuel from the high pressure fuel pump 10 to the ejection aperture 72 while suppressing pressure loss thereof to the greatest possible extent.

Moreover, since the fuel pipe from the fuel tank 6 may be a low pressure one (the low pressure fuel pipe 8), rather than the high pressure fuel passage 18, and thus it is possible to eliminate the high pressure fuel pipe, accordingly it is possible to anticipate a reduction in the overall cost.

Accordingly, this device is suitable in the case of application to a direct injection type engine whose responsiveness is high, since it is possible to perform injection while maintaining the pressure of the fuel which is supplied into the combustion chamber 11 of the engine E at a high pressure which corresponds to the pressure within the combustion chamber 11 of the engine E.

Figure 8:
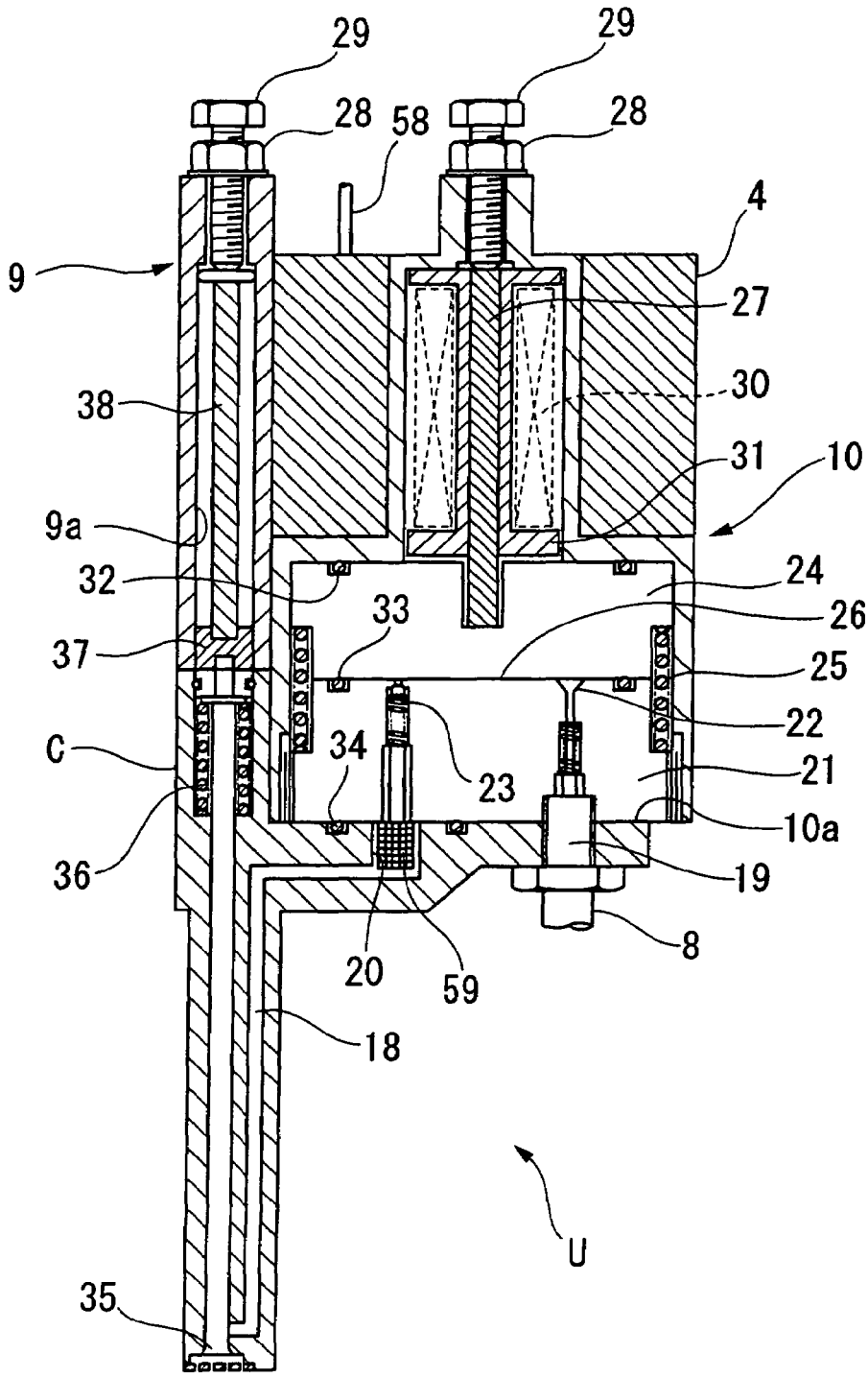
FIG. 8 is a sectional view corresponding to FIG. 2, of the third embodiment of the present invention.

Next, a third embodiment will be explained based upon FIG. 8.

In the embodiments, the driver unit 4 was only shown as a structural element, and its concrete arrangement and positioning were not explained; but, in this embodiment, the driver unit 4 (for convenience, shown in the figure by hatching) is arranged so as to surround the magnetostrictive element 27.

Instead of the harness 39 and the coupler 40 for electrical supply which were extended from the coil described in the explanation of FIG. 2, a harness 58 is provided to the driver unit 4, for connecting the driver unit 4 and the control unit 3.

It should be understood that, since the other structures and operation are the same as for the previously described embodiments, the same reference symbols are affixed to the same parts, and explanation thereof will be curtailed.

Thus, according to this embodiment, by arranging the driver unit 4 around the perimeter of the magnetostrictive element, it is possible to eliminate the harness 39 which previously extended from the coil for electrical supply thereto and the coupler 40, in order to connect from the magnetostrictive element 27 and the piezo element 38 to the driver unit 4. Furthermore, it is possible to take efficient advantage of the space around the magnetostrictive element 27, and it becomes possible further to reduce the space occupied by the system as a whole.

Figure 9:
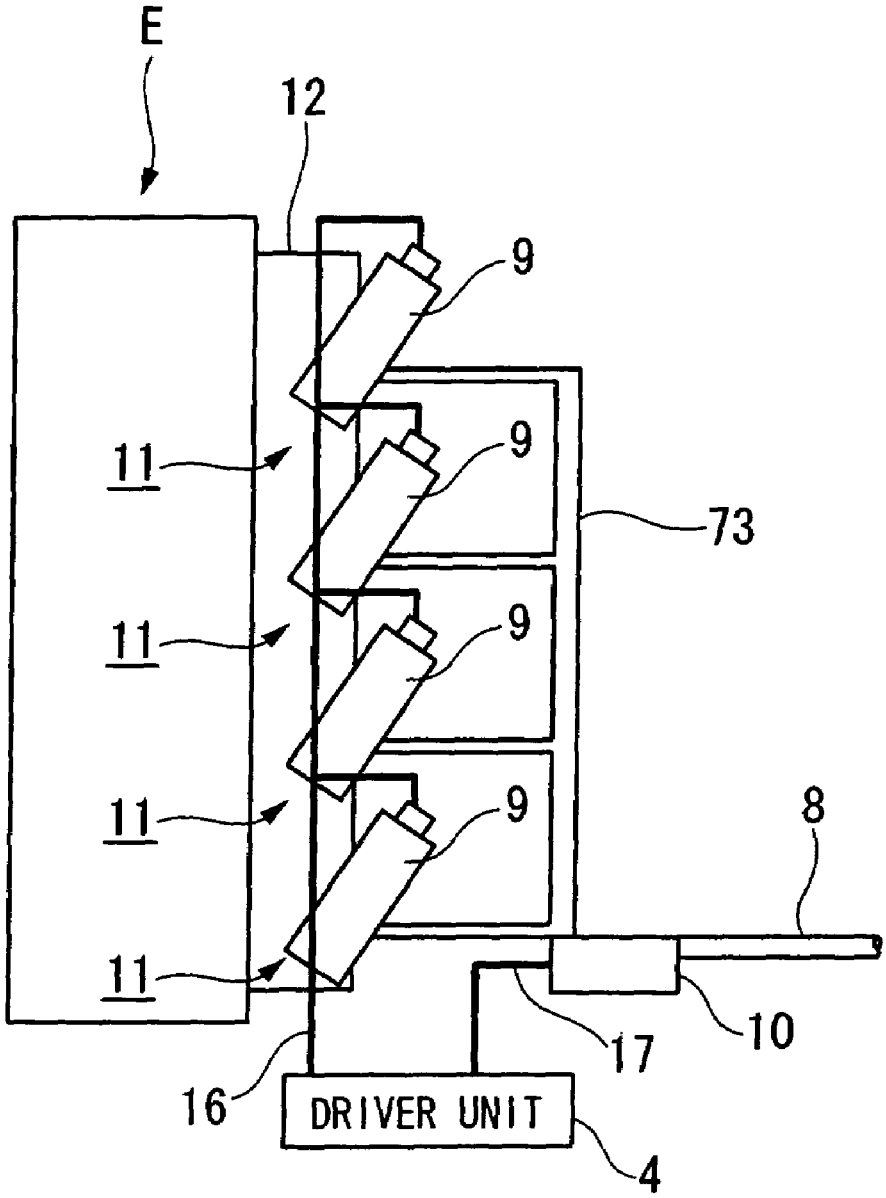
FIG. 9 is a sectional view corresponding to FIG. 2, of the fourth embodiment of the present invention.

Next, a fourth embodiment will be explained based upon FIG. 9.

While in the previously described first through third embodiments the high pressure pump which used a magnetostrictive element or the driver unit 4 was formed as a unit with the injector 9, in this fourth embodiment, the high pressure fuel pump 10 is provided in the vicinity of the injector 9.

The low pressure pump 7 which is provided to the fuel tank 6 is connected via the low pressure pump 7 to the high pressure fuel pump 10. The injectors 9 are connected from the high pressure fuel pump 10 via a high pressure fuel pipe 73.

It should be understood that, since the other structures and operation are the same as for the previously described third embodiment, the same reference symbols are affixed to the same parts, and explanation thereof will be curtailed.

Accordingly, in this embodiment, since the high pressure fuel pump 10, the injectors 9, and the driver unit 4 are disposed adjacent to one another, accordingly the distances between each of the high pressure fuel pump 10, the injectors 9, and the driver unit 4 are shortened, it is possible to shorten the signal lines 16 and 17 and the high pressure distribution conduit 73 which connect them. Therefore, it is possible to anticipate a reduction in the cost.

It should be understood that the present invention is not limited to the above described embodiments; for example, if it is used in a two wheeled vehicle or the like, there is the beneficial aspect that, since the engine E is laid out directly below the fuel tank 6, the low pressure pump 7 becomes unnecessary, and it becomes possible to connect directly from the fuel tank 6 to the connection port 19 of the high pressure fuel pump.

Furthermore, although the explanation has been made in terms of the case of application to a four cylinder in line engine, the present invention is not limited to this application; it could be applied to engines of various different layouts, with various numbers of cylinders.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A fuel injection control device comprising:

a fuel injection valve;

a driving element which drives the fuel injection valve;

a fuel pump which pressurizes fuel and supplies it to the fuel injection valve;

a magnetostrictive element which drives the fuel pump; and a magnetostrictive element driving coil which drives the magnetostrictive element;

wherein the magnetostrictive element driving coil also serves as a voltage elevation coil for a drive circuit which drives the driving element.

2. A fuel injection control device according to claim 1, wherein the fuel injection valve and the fuel pump are integrated together.

3. A fuel injection control device according to claim 2, further comprising:

a driver unit; and a drive circuit that drives the magnetostrictive element, wherein the drive circuit which drives the magnetostrictive element and the drive circuit which drives the driving element are provided within the driver unit; and the driver unit is integrated with the fuel injection valve and the fuel pump.

4. A fuel injection control device according to claim 1, wherein the drive circuit which drives the magnetostrictive element and the drive circuit which drives the driving element are provided within a driver unit; and the driver unit, the fuel pump, and the fuel injection valve are provided adjacent to one another.

5. A fuel injection control device according to claim 1, wherein, a high pressure fuel passage which supplies fuel from the fuel pump to the fuel injection valve is provided in the vicinity of an opening and closing valve of the fuel injection valve.

6. A fuel injection control device according to claim 2, wherein, a high pressure fuel passage which supplies fuel from the fuel pump to the fuel injection valve is provided in the vicinity of an opening and closing valve of the fuel injection valve.

7. A fuel injection control device according to claim 3, wherein, a high pressure fuel passage which supplies fuel from the fuel pump to the fuel injection valve is provided in the vicinity of an opening and closing valve of the fuel injection valve.

8. A fuel injection control device according to claim 4, wherein, a high pressure fuel passage which supplies fuel from the fuel pump to the fuel injection valve is provided in the vicinity of an opening and closing valve of the fuel injection valve.

9. A fuel injection control device according to claim 1, wherein the driving element comprises a solenoid.

10. A fuel injection control device according to claim 1, wherein the driving element comprises a piezoelectric element.

* * * * *